US009315044B2

(12) United States Patent
Dullaert et al.

(10) Patent No.: US 9,315,044 B2
(45) Date of Patent: Apr. 19, 2016

(54) LABEL PRINTER

(75) Inventors: Jimmy Dullaert, Stekene (BE); Jeroen Leyman, Sint-Laureins (BE); Jos Vleurinck, Oordegem (BE); Pieter Vanysacker, Moere (BE)

(73) Assignee: DYMO, Sint-Niklaas (BE)

( * ) Notice: Subject to any disclaimer, the term of this patent is extended or adjusted under 35 U.S.C. 154(b) by 60 days.

(21) Appl. No.: 13/637,333

(22) PCT Filed: Mar. 28, 2011

(86) PCT No.: PCT/EP2011/054726

§ 371 (c)(1),
(2), (4) Date: Nov. 29, 2012

(87) PCT Pub. No.: WO2011/117419

PCT Pub. Date: Sep. 29, 2011

(65) Prior Publication Data

US 2013/0063780 A1 Mar. 14, 2013

(30) Foreign Application Priority Data

Mar. 26, 2010 (GB) ..... 1005148.0

(51) Int. Cl.
*B41J 3/407* (2006.01)

(52) U.S. Cl.
CPC ..... *B41J 3/4075* (2013.01)

(58) Field of Classification Search
CPC ..... B41J 3/4075; B41J 3/46; B41J 11/003; H04N 5/2628; G06F 17/211; G06K 2215/0037; G06K 2215/0057; G06K 2215/0097
USPC ..... 358/1.15, 1.9, 1.2, 296; 345/471, 472
See application file for complete search history.

(56) References Cited

U.S. PATENT DOCUMENTS

| | | | | | |
|---|---|---|---|---|---|
| 5,503,482 | A | * | 4/1996 | Kawakami et al. | 400/83 |
| 5,562,353 | A | * | 10/1996 | Handa et al. | 400/615.2 |
| 5,737,504 | A | * | 4/1998 | Yamada | 358/1.18 |
| 6,079,889 | A | * | 6/2000 | Beadman et al. | 400/615.2 |
| 6,498,659 | B1 | * | 12/2002 | Konishi | 358/1.18 |
| 7,184,167 | B1 | * | 2/2007 | Ito et al. | 358/1.18 |
| 2006/0112333 | A1 | | 5/2006 | Iwanaga | |

(Continued)

FOREIGN PATENT DOCUMENTS

| | | | |
|---|---|---|---|
| JP | 08-183222 | A | 7/1996 |
| WO | WO-2004/034278 | A1 | 4/2004 |

OTHER PUBLICATIONS

International Search Report from PCT/EP2011/054726, dated Jul. 22, 2011.

(Continued)

*Primary Examiner* — Jacky X Zheng
(74) *Attorney, Agent, or Firm* — Marshall, Gerstein & Borun LLP

(57) ABSTRACT

A label printer comprises input means operable by a user to input label data. The label printer also has display means and control means configured to receive said input label data from the input means. The control means is arranged to control the display to display an image of a label defined by said input label data in a label display area. The control means is configured to cause the display to display said image of the label such that a first dimension of the image of the label is decreased with respect to the corresponding dimension of said display area so that all of said image of the label is displayed in said display area.

14 Claims, 14 Drawing Sheets

(56) References Cited

U.S. PATENT DOCUMENTS

| | | | | |
|---|---|---|---|---|
| 2006/0176376 | A1* | 8/2006 | Dyke et al. | 348/222.1 |
| 2007/0283249 | A1 | 12/2007 | Nose et al. | |
| 2011/0286012 | A1* | 11/2011 | De Munck et al. | 358/1.6 |

OTHER PUBLICATIONS

Japanese Office Action for Patent Application No. 2013-501787, dated Mar. 3, 2015.

* cited by examiner

LABEL PRINTER

CROSS-REFERENCE TO RELATED APPLICATIONS

This application is the US national phase under 35 USC §371 of international application no. PCT/EP2011/054726, filed Mar. 28, 2011, and claims priority to GB 1005148.0, filed Mar. 26, 2010. The entirety of each of PCT/EP2011/054726 and GB 1005148.0 is incorporated herein by reference.

FIELD OF THE DISCLOSURE

The present invention relates to a label printer for printing an image onto a label, and in particular a stand-alone label printer. It also relates to a method of operating control means of a label printer, and to a computer program, embodied on a computer readable medium, which is configured to control control means of a label printer.

RELATED ART

Known label printing apparatuses are disclosed in EP-A-322918 and EP-A-322919 (Brother Kogyo Kabushiki Kaisha) and EP-A-267890 (Varitronic). The label printing apparatuses each include a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double sided adhesive tape which is secured at one of its adhesive coated sides to the image tape after printing and which has a backing layer peelable from its other adhesive coated side. With both these apparatus, the image transfer medium (ink ribbon) and the image receiving tape (substrate) are in the same cassette.

It has also been proposed by the present applicants in, for example, EP-A-578372 to house the ink ribbon and the substrate tape in separate cassettes.

In all of these cases, the image receiving tape passes in overlap with the ink ribbon to a print zone consisting of a fixed print head and a platen against which the print head can be pressed to cause an image to transfer from the ink ribbon to the image receiving tape. There are many ways of doing this, including dry lettering or dry film impression, but the most usual way currently is by thermal printing where the print head is heated and the heat causes ink from the ink ribbon to be transferred to the image receiving tape.

In other known tape printing apparatuses, so-called direct thermal tapes are used, in which an image is created directly onto the direct thermal tape without the interposition of an ink ribbon cassette. Elements of a print head are heated, and the heat causes chemicals within the direct thermal tape to react and produce an image in or on the tape.

The apparatuses of the type described above are provided with a keyboard which enables a user to enter characters, symbols and the like to form an image to be printed by the tape printer. The keyboard usually has text character keys and number keys for entering letters and numbers respectively, plus some function keys which, among other things, operate menus and allow printing attributes to be set.

"Stand-alone" label printers can be distinguished from "label printer systems", which comprise a printer connected to a PC or other computing device. In such label printer systems, a user creates or edits a label for printing using a PC, and then sends print data to a printer to cause the printer to print the print data onto a label medium. In such label printer systems, the user will view a display of the PC to create a label, rather than a display of the printer. Also, the label-editing software used for creating the label will be stored and run on the PC, rather than the printer.

In contrast, stand-alone label printers are operable independently of a PC or other computer to create and print a label. Although some stand-alone printers are connectable to a PC or other computer to receive some data, they are nevertheless operable independently of the PC or other computer to create a label for printing, since label-editing software used for creating the label is stored and run on the label printer itself. Stand-alone label printers thus usually include an integral display via which the user can view an interface of the label-editing software.

Such a display of a known label printer enables a user to view an image representative of a label they are creating using the printer, including label data intended to be printed onto a label medium.

Many known label printers are of a relatively compact design, and therefore have small displays, such as displays with an area of 50 $cm^2$ or less. Such displays often include an image representative of a label being created and an information region that various other information associated with the label medium and/or label data entered for printing onto the label medium. With such displays one or both of the image representative of the label medium and the information region may only be permitted to occupy a small area, which can make it hard for the user to read the information included in the information region and/or to view the label being created.

As discussed above, some known label printers have a relatively small screen on which to display information to a user. Many of these known devices suffer from the problem that, because there is so much information included on the display for the user to consider, each element of the information is quite small, and thus not easily read or understood by the user.

SUMMARY OF THE DISCLOSURE

According to a first aspect of the invention, there is provided a label printer comprising input means operable by a user to input label data; display means; and control means configured to receive said input label data from the input means and to control the display to display an image of a label defined by said input label data in an label display area, wherein said control means is configured to cause said display to display said image of the label such that a first dimension of said image of the label is decreased with respect to the corresponding dimension of said display area so that all of said image of the label is displayed in said display area.

According to another aspect of the invention, there is provided a label printer comprising input means operable by a user to input label data; display means; and control means configured to receive said input label data from the input means and to control the display to display an image of a label defined by said input label data in an label display area, wherein said control means is configured to cause said display to display said label image such that all of said label image is displayed only if a first dimension of said label image is above a predetermined value with respect to a corresponding dimension of the display area.

According to another aspect of the invention, there is provided a method for controlling a display of a label printer, said method comprising receiving input label data; reducing a first dimension of said image of the label with respect to the corresponding dimension of a display area of said display so that all of said image of the label can be accommodated in said display area; and causing said display to display an image of said label in said label display area.

According to a further aspect of the invention, there is provided a method for controlling a display of a label printer, said method comprising receiving input label data; and controlling the display to display an image of a label defined by said input label data in an label display area, wherein said controlling is such that all of said label image is displayed only if a first dimension of said label image is above a predetermined value with respect to a corresponding dimension of the display area.

BRIEF DESCRIPTION OF THE SEVERAL VIEWS OF THE DRAWING

Reference will now be made by way of example only to the accompanying drawings in which.

DETAILED DESCRIPTION OF THE PREFERRED EMBODIMENTS

Label printers that embody the present invention are "stand-alone" label printers, as they are operable by a user independently of a PC or other computer to create and print a label. Although some embodiments of the stand-alone label printer of the present invention are connectable to a PC or other computer or device to receive e.g. software upgrades, label templates, print data, etc., they are nevertheless operable by a user without being so connected to edit or create a label for printing, since the label-editing software used for creating the label is stored and run on the label printer itself.

The stand-alone label printer may comprise a display formed integrally with the label printer, via which display the user can view an interface of the label-editing software to create or edit a label. The stand-alone label printer may also comprise a series of input keys, which can be software keys displayed on the integral display and operable by a user touching a touchscreen overlying the display, and/or hardware keys integral with the label printer. Such a touchscreen is preferably integrally formed with the body of the label printer, such that the touchscreen is not a separate device connected wirelessly or with wires to the label printer. Thus, data defining a label to be printed can be created and/or manipulated in the stand-alone label printer itself, based on inputs made by the user via the input keys, and the data need not be sent to the label printer from a PC or other computer or other device connected wirelessly or with wires to the label printer.

Some embodiments of the present invention may comprise a portable or handheld stand-alone label printer. Other embodiments may comprise a larger stand-alone label printer which is optimally placed on a surface, such as a desk, before being operated.

Figure 1:
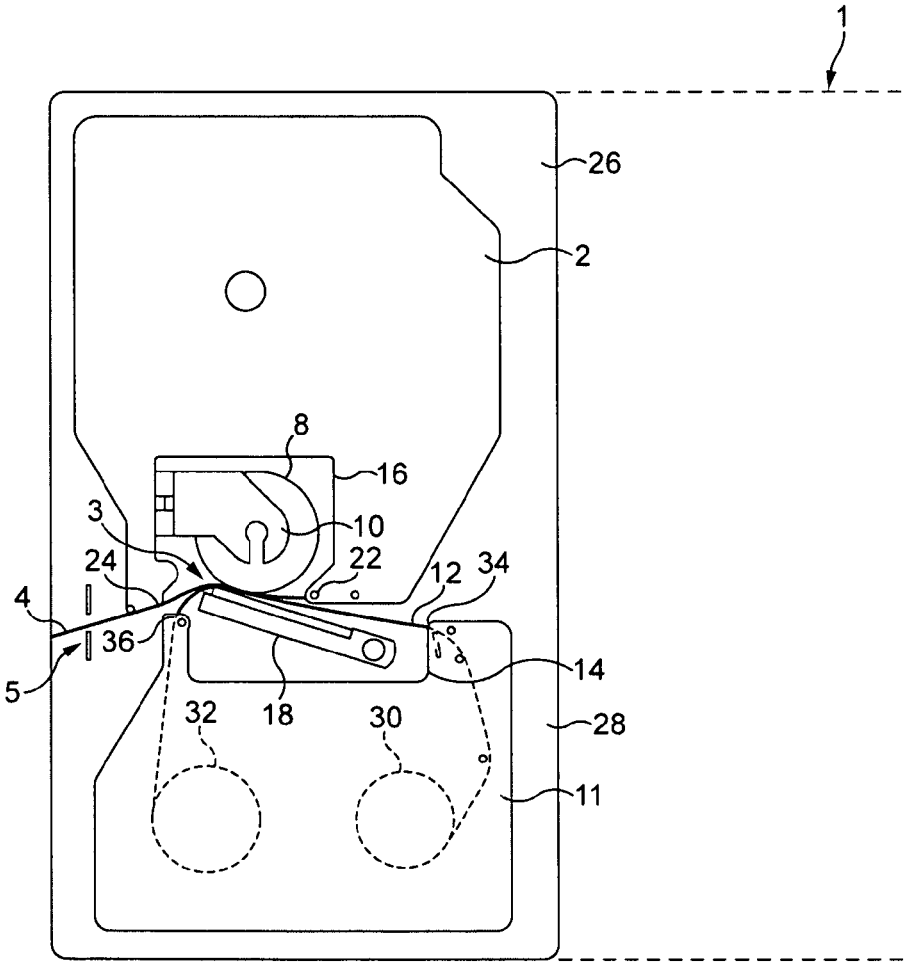
FIG. 1 is a plan view of a first label printer using a two cassette system.

FIG. 1 shows in plan view a first label printer which has two cassettes arranged therein. Typically, this label printer is powered by batteries at least part of the time. Alternatively the label printer may be mains powered.

The upper cassette is located in a first cassette receiving portion 26 and contains a supply of image receiving tape 4 which passes through a print zone 3 of the label printer 1 to an outlet 5 of the label printer 1. The image receiving tape 4 comprises an upper layer for receiving a printed image on its upper surface and has its other surface coated with an adhesive layer to which is secured a releasable backing layer. The upper cassette 2 has a recess for accommodating a platen 8 of the label, printer 1, and guide portions 22 and 24 for guiding the tape through a print zone 3. The platen 8 is mounted for rotation within a cage moulding 10. Alternatively the platen could be mounted for rotation on a pin.

The lower cassette 11 is located in the second cassette receiving portion 28 and contains a thermal transfer ribbon 12 which extends from the supply spool 30 to a take-up spool 32 within the cassette 11. The thermal transfer ribbon 12 extends through the print zone 3 in overlap with the image receiving tape 4. The cassette 11 has recess 14 for receiving a print head 18 of the label printer 1 and guide portions 34 and 36 for guiding the thermal transfer ribbon 12 through the print zone 3. Print head 18 is moveable between an operative position shown in FIG. 1, in which it is in contact with the platen 8 and holds the thermal transfer ribbon 12 and the image receiving tape 4 in overlap between a print head 18 and the platen 8 in an inoperative position in which it is moved away from the platen 8 to release thermal transfer ribbon 12 and image receiving tape 4. In the operative position, the platen 8 is rotated to cause the image receiving tape 12 to be driven past print head 18 and the print head 18 is controlled to print an image on the image receiving tape 4 by thermal transfer of ink from the ribbon 12. Each of the printing elements on the print head 18 is activatable separately and is activated in accordance with the desired image to be printed. The label printer 1 has a lid (which is not shown) which is hinged along the rear of the cassette receiving portions 26 and 28 and which covers both cassettes when in place.

A DC motor 7 (see FIG. 3) continuously drives the platen 8. The platen is arranged to drive the image receiving tape 4 through the print zone 3 by the actuation of its own rotation. In other embodiments, transport of the image receiving tape across the print head can be done by other means, such as by a separate driven roller of the printer or of the cassette, or by a pair of cooperating rollers positioned on opposite sides of the tape, or by other means.

The image is printed by the print head 18 on the image receiving tape on a column by column basis with the columns being adjacent one another in the direction of movement of the tape 4.

Figure 2:
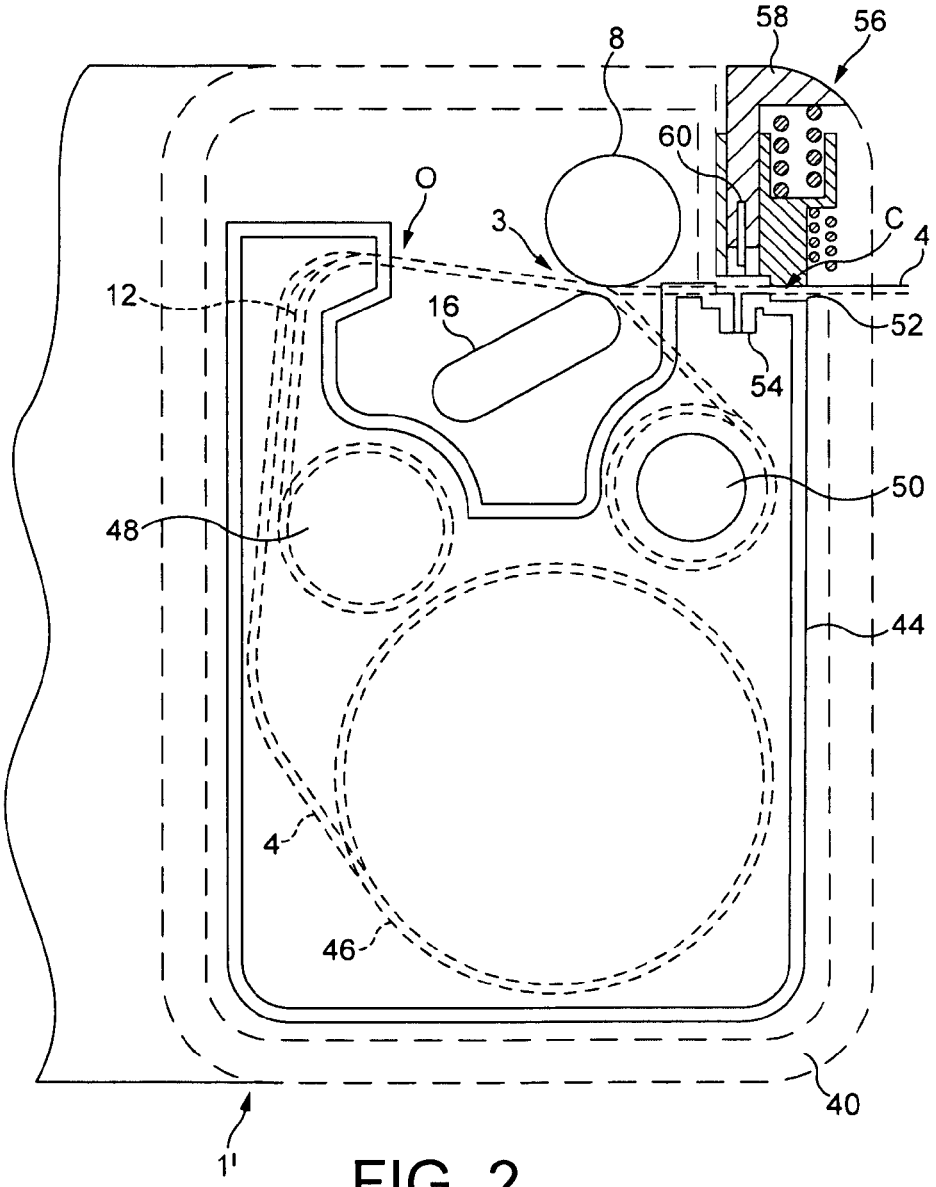
FIG. 2 is a plan view of a second label printer using a one cassette system.

FIG. 2 illustrates in plan view a cassette bay of a second label printer 1' which uses a one cassette system. Like reference numerals are used for those parts which are also shown in FIG. 1. The cassette bay is shown by the dotted line 40. The cassette bay 40 includes a thermal print head 18 and a platen 8 which cooperate to define a print zone 3.

The print head 18 is pivotable about a pivot point so that it can be brought into contact with the platen 8 for printing and moved away from the platen 8 to enable the cassette to be removed and replaced as in the first embodiment. A cassette inserted into the cassette bay 40 is denoted generally by reference numeral 44. The cassette 44 holds a supply spool 46 of image receiving tape 4. The image receiving tape 4 is guided by a guide mechanism (which is not shown) through the cassette 44, past the print zone 3 and out of the cassette 44 through an outlet O to a cutting location C. The same cassette 44 also has an ink ribbon supply spool 48 and an ink ribbon take up spool 50. The ink ribbon 12 is guided from the ink ribbon supply spool 48 through the print zone 3 and taken up on the ink ribbon take up spool 50. As with the first embodiment, the image receiving tape 4 passes in overlap with the ink ribbon 12 through the print zone 3 with its image receiving layer in contact with the ink ribbon 12. The platen of this second embodiment is also driven by a motor 7. The motor rotates to drive continuously the image receiving tape through the pint zone 3 during printing. In either of the embodiments, it is possible that the tape be driven in a step wise manner by a stepper motor.

An image is printed on the tape fed out from the print zone to the cutting location C which is provided at a location in a portion of the wall of the cassette 44 which is close to the print zone 3. The portion of the wall on the cassette 44 where the cutting location C is defined is denoted by reference 52. A slot 54 is defined in the wall portion 52 and the image receiving tape 4 is fed past the print zone 3 and out of the cassette 44 through an outlet O to the cutting location C where it is supported by facing wall portions on either side of the slot 54.

The second label printing device 1' includes a cutting mechanism 56 including a cutter support member 58 which carries a blade 60. The blade 60 cuts the image receiving tape 4 and then enters the slot 54. It should be appreciated that the first embodiment will usually also include a cutting mechanism.

These example label printers 1 and 1' are stand-alone printing devices including a controller for receiving inputs from a user and to alter what is displayed on a display of the printing devices. This arrangement contrasts with label printing systems comprising printers that are connectable or connected to a PC, and in which it is the PC which includes the controller to receive inputs from a user and to alter what is displayed on a display of the printer or of the PC. The present invention is concerned only with stand-alone label printers.

Figure 3:
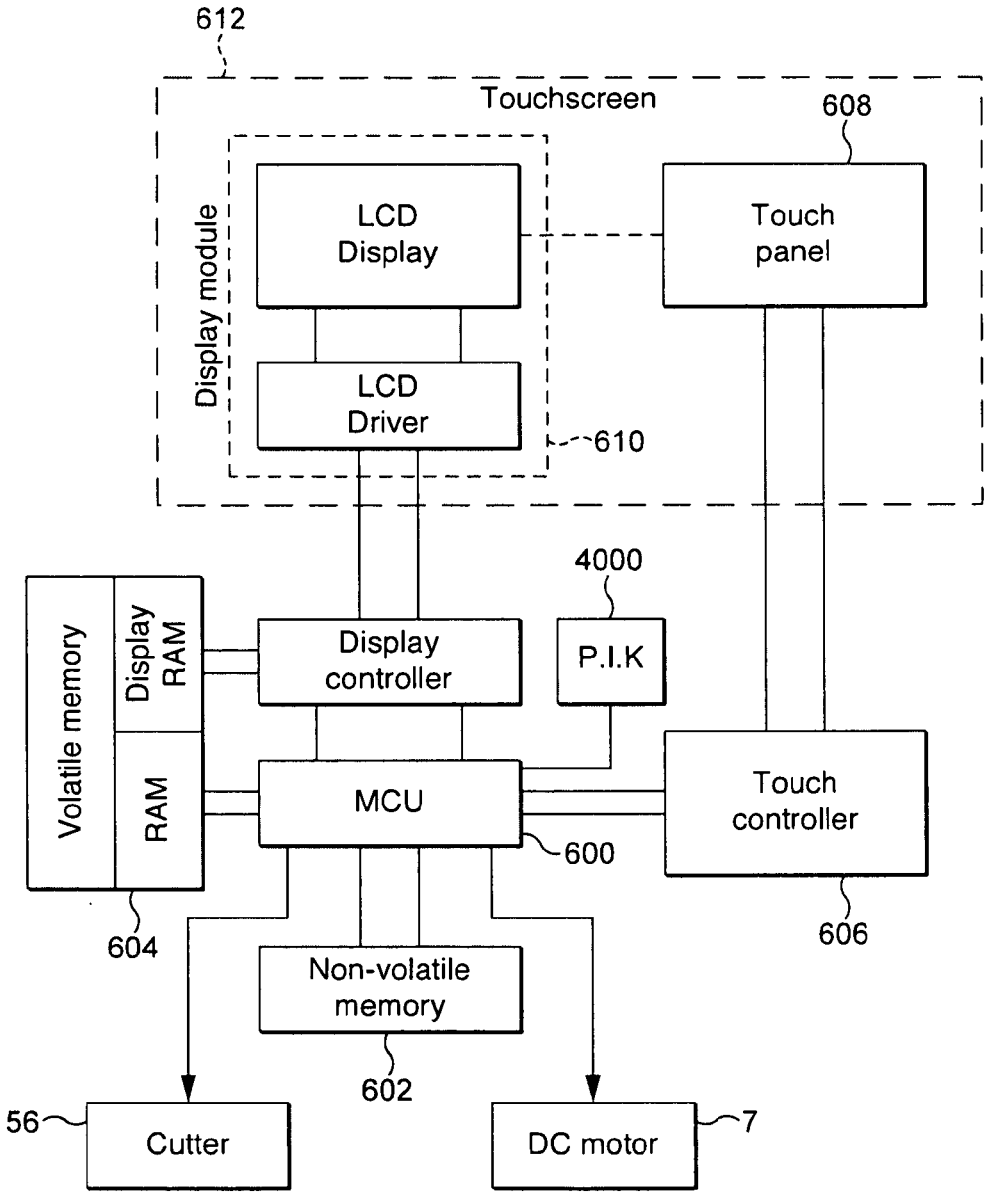
FIG. 3 is a diagrammatic sketch showing the control circuitry in an embodiment of the present invention.

Basic circuitry for controlling the stand-alone label printer 1 of FIG. 1 or the label printer 1' of FIG. 2 is shown in FIG. 3. There is a controller or "control means" (such as a micro controller unit (MCU)) 600, a non-volatile memory 602 which is for example a read only memory (ROM) or a flash type of memory. The flash type of memory may be used in place of, or in addition to the read only memory. A volatile memory comprising a random access memory RAM 604 and/or display RAM is also provided. The MCU 600 is connected to receive label data input to it from a data input device such as a touch panel 608 of a touchscreen 612 via a touch panel controller 606. In alternative embodiments, the data input device may comprises one or more of a hardware keyboard including plural keys, a mouse, a digital pen or tracker ball, or any other means for enabling a user to send commands to the controller 600. In some embodiments, the touchscreen 612 is omitted. The MCU 600 outputs data to drive the display 610 (which together with the touch panel 608 form the touchscreen 612) to display a label to be printed (or a part thereof) and/or a message for the user. Additionally, the MCU 600 also outputs data to drive the print head 18 so that the label data is printed onto the image receiving tape to form a label. Finally, the MCU 600 also controls the motor 7 for driving the platen. The MCU 600 may also control the cutting mechanism 56 of FIG. 2 or a cutting mechanism of the device shown in FIG. 1 to allow a length of tape to be cut off. In alternative embodiments at least part of the cutting mechanism may be manually operated.

FIG. 3 also illustrates a print instructor key (PIK) 4000, which is present in some embodiments and omitted in others. In some embodiments, the print instructor key (PIK) 4000 is omitted and instead a portion of the touch panel 608 comprises a print instructing button.

In other embodiments, the label printer does not include an ink ribbon, and the print head creates an image directly onto direct thermal tape. In those embodiments similar circuitry 200 can be provided.

FIG. 3 illustrates an embodiment where all these components shown in FIG. 3 are included in a stand-alone label printer. This contrasts with label printer systems that comprise a printer connected to a PC.

Figure 4:
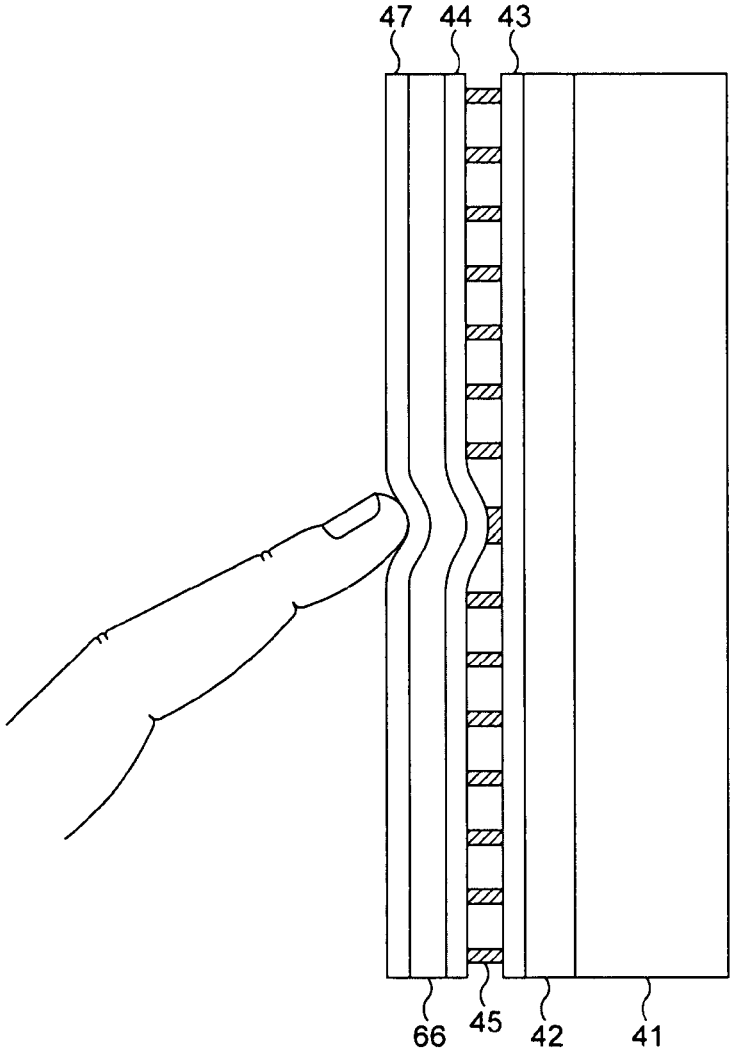
FIG. 4 is a diagram of a resistive touch screen used as an input device according to some embodiments of the present invention.

A touch panel 608 is shown in FIG. 4. FIG. 4 shows a resistive touchscreen system, which may be integrally included in the label printer of some embodiments of the present invention. There are other touchscreen systems that are used to recognise a person's touch that are well known in the art and could be used in place of the resistive system and still be within the scope of some embodiments of this invention. Such systems include the capacitive touchscreen system, in which a local change of capacitance is sensed and used to determine the point at which the screen was touched, and the surface acoustic wave touchscreen system. However reference will only be made to the resistive touchscreen system as an example of an embodiment with reference to FIG. 4.

The resistive touchscreen system consists of a glass (or other suitable material such as plastics) panel 42 overlying the LCD display or any other type of display 41. The glass panel 42 is covered in a uniform resistive coating 43. A thick polyester cover sheet 66 is suspended over the resistive coating 43, separated by small transparent insulating dots 45. The surface of the coversheet facing the glass panel 42 is covered in a conductive coating 44. The opposite outer side of the coversheet 66 is covered in a scratch resistant coating 47.

Figure 4A:
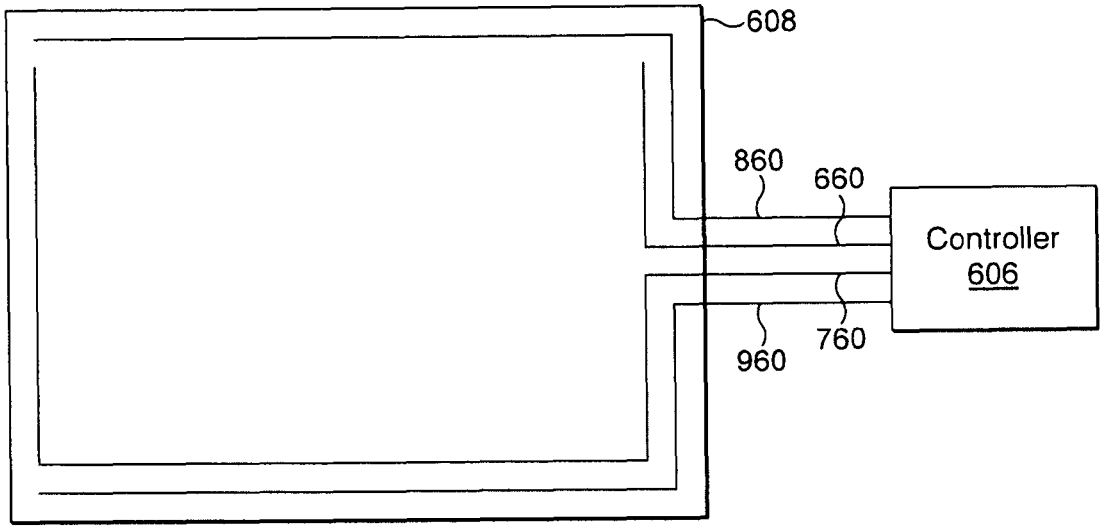
FIG. 4*a* is a diagram showing the wiring of the resistive touch screen of FIG. 4.

Four wires are arranged within the touch screen panel 608. Wires 660 and 760 are arranged at the respective side edges of one of the conductive surface 44 and the resistive layer 43, as shown in FIG. 4*a*. Wires 860 and 960 are arranged at the respective top and bottom edges of the other of the conductive surface 44 and the resistive layer 43. The resistive layer 43 is biased at the supply voltage (for example +5V or 3.3V) through four drive lines (not shown), and the coversheet is grounded through a high resistance. When the screen is touched the conductive coating 44 on the coversheet 46 is pushed against the resistive coating 43 on the glass panel 42, making electrical contact an electrical current runs through the conductive and resistive metallic layers. The voltage produced between the point of contact between the conductive layer 44 and resistive layer 43 and between the wires 660, 760, 860 and 960 are detected by the controller. Wires 660 and 760 detect the voltage produced by the touch along the x axis, whist wires 860 and 960 detect the voltage produced along the Y axis. The wires 660, 760, 860 and 960 are connected to analogue to digital converter (not shown) which forms part of the touch screen controller 606. The analogue to digital converter converts the voltages into a digital signal. The controller 606 translates the signal into x and y coordinates to be sent to the MCU 600.

Various example embodiments of the present invention will now be described with reference to the figures.

FIGS. 5*a* to 5*g* show a display 610 of a label printer embodying the present invention. In this embodiment the display 610 is comprised in a touch screen 612, such as that described above. In other embodiments the display 610 may not be part of a touch screen, in which case users of the label printer provide an input to the label printer by way of secondary peripherals, such as a mouse, a mouse pad or a tracker ball, etc. The label printer also comprises a controller 600, as described above with reference to FIG. 3. The controller 600 is configured to control the display 610.

The controller 600 is configured to control the display 610 to display an image 1002 representative of a label medium in a first section (labelled "A" in FIG. 5*a*) of the display 610. Underneath the first section A of the display 610, the controller 600 is configured to control the display 610 to display a series of selectable headers 1004, 1006 and 1008 in a second section (labelled as "B" in FIG. 5*a*) of the display 610. Each of these headers 1004, 1006, 1008 comprises a "tab", with which a respective graphical control panel is associated.

Figure 5A:
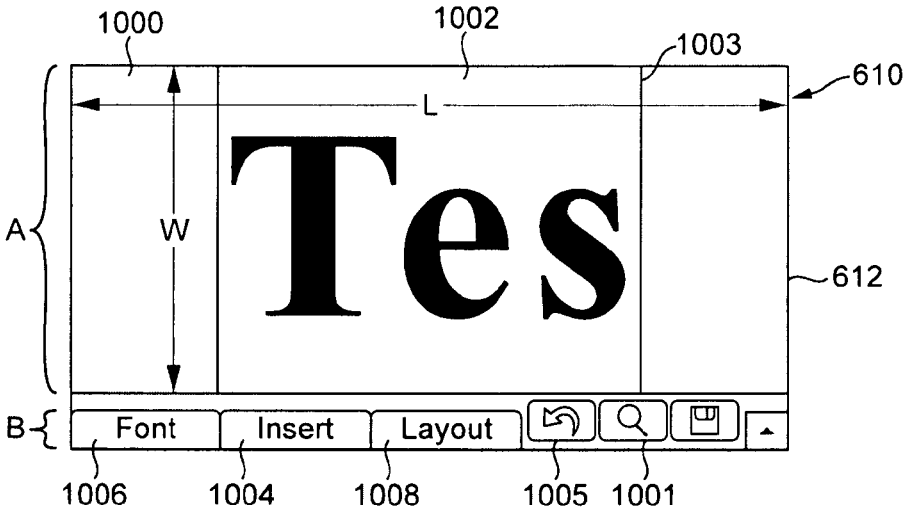
FIGS. 5*a* to 5*g* show a display of a label printer as a series of characters are input and displayed.

As can be seen in FIG. 5*a*, the image 1002 representative of a label medium occupies the majority of the display 610. In this embodiment, the user can enter label data for printing onto a label medium by touching any part of the touch panel 608 overlying this first image 1002 representative of a label medium in the display 610. After having touched the touch panel 608 in this way, a cursor 1003 is shown overlying the first image 1002 of the label medium to indicate a label data input point. The user can use a keyboard of the label printer, which in this embodiment is a hardware keyboard but in other embodiments may comprise a representation of a keyboard on the display 610, to enter text and other label data. Meanwhile, the headers 1004, 1006 and 1008 are shown in a "collapsed" state, i.e. only the headers are visible to a user and the associated graphical control panels are hidden from view. Due to this arrangement, the user is able to clearly see the image 1002 representative of the label medium, as it is provided in an enlarged state on the display 610.

In addition to entering text label data by way of the keyboard or touch screen as described above, the user may want to add some other form of label data to the label being created. Examples of such label data include barcodes, images, symbols, shapes, and decorative elements such as borders and backgrounds. In order to add one of these types of label data, the user selects the header 1004 labelled "insert" by touching a portion of the touch panel 608 which overlies the header 1004. Touching this portion of the touch panel 608 causes a signal indicative of a selection of the header 1004 by the user to be sent to the controller 600 of the label printer. In response to this, the controller 600 controls the display 610 to display a revised image representative of the label medium and a graphical control panel.

If the user selects the font tab/header 1006 shown in FIG. 5*a* then the controller 600 receives a signal indicative of this selection by the user of that element 1006. The controller 600 then controls the display 610 to display a font graphical control panel. By way of this font graphical control panel 1052, the user is able to change one or more attributes of a font of text label data included in a label being created.

When the screen illustrated in FIG. 5*a* is displayed on the display 610, the user can alter the layout of aspects of the label being created by selecting the "layout" header 1008 in the second section B of the display 610. In response to receiving at the controller 600 a signal indicative of this selection of the layout element 1008 by the user, the controller 600 is configured to control the display 610 to display the layout selection screen.

FIGS. 5*a* to 5*g* show the display as shown in FIG. 5*a* but with increasing number of characters input into the label.

The display comprises an area 1000 which is provided for displaying the label as the label data is entered. The area 1000 has a width W and a length L. The width and length directions are respectively shown in FIG. 5*a*. In some embodiments the length direction of the area 1000 represents the length of the tape and/or backing layer of labels, parallel to the direction of travel of the tape/backing layer through the label printer. The width direction W, in some embodiments of the invention represents the width of the tape/backing layer which extends parallel to the axis of the print head. Of course, the width and length directions of the display may represent the opposite dimensions of a label, in some embodiments.

In FIG. 5*a*, the user starts entering characters into a new label and the image of the label in the width direction of the display area 1000 takes up 100% of the display area which is provided for showing the label.

Figure 5B:
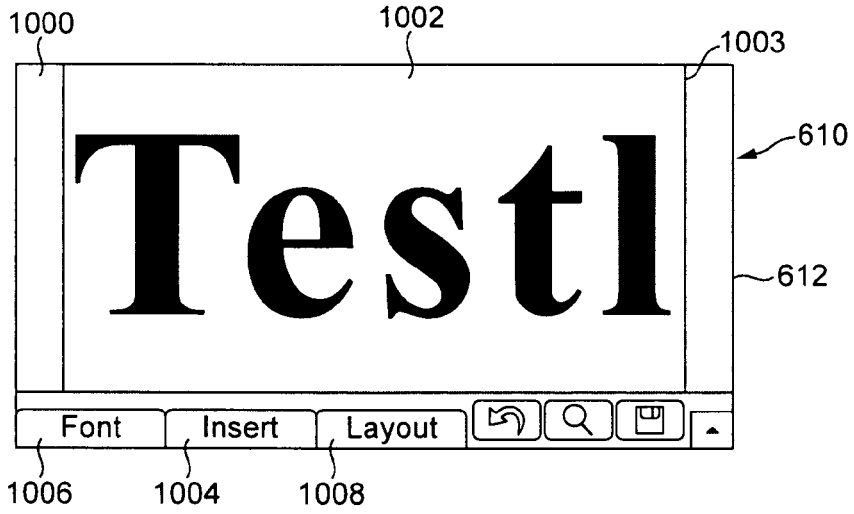

FIG. 5*b* is now considered where two more characters have been entered compared to FIG. 5*a*. It can be seen that the image of the label occupies 100% of the display area 1000 in the width direction but the label has increased in the length direction.

Figure 5C:
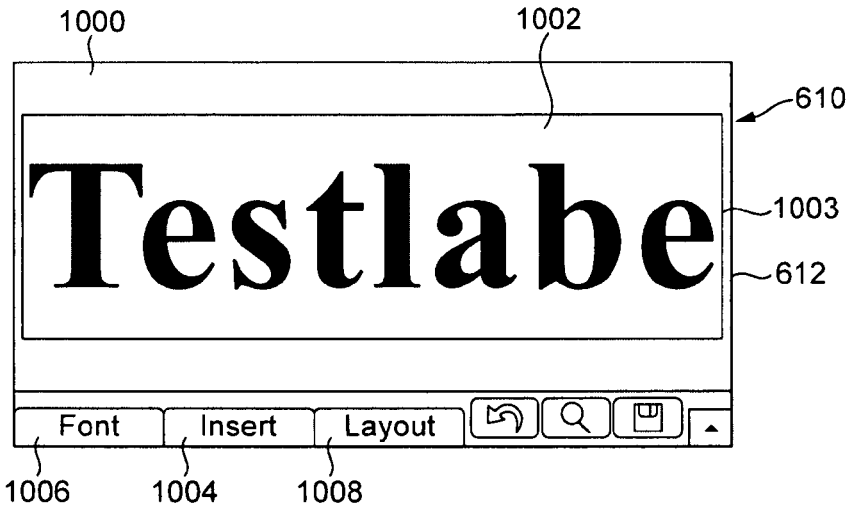

A comparison is now made between FIGS. 5*b* and 5*c*. In this embodiment, the user has continued to input characters. Five extra characters have been entered. However, if the width of the label displayed in display area 1000 is maintained at 100% of the available width of the display, some characters would not be displayed. For example the characters at the beginning and/or end of the display would not be displayed. Accordingly, in FIG. 5*c*, the width of the displayed label is decreased with a calculated value to make maximum use of the available display area 1000. In the example of FIG. 5*c*, the width of the displayed label is 68% of the available width W of the display area 1000 and all of the characters which have been input are displayed.

Figure 5D:
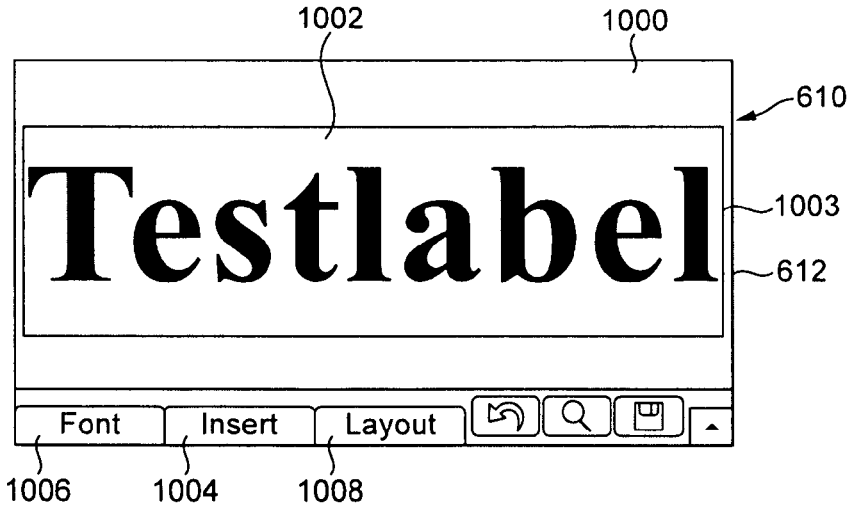

Comparing FIG. 5*c* with 5*d*, an additional character has been input. The additional character is further taken into account in the calculated value to make maximum use of the available display area 1000. In the example of FIG. 5*d*, the width of the displayed label is 63% of the available width W of the display area and all of the characters which have been input are again displayed making maximum use of the available display area.

Figure 5E:
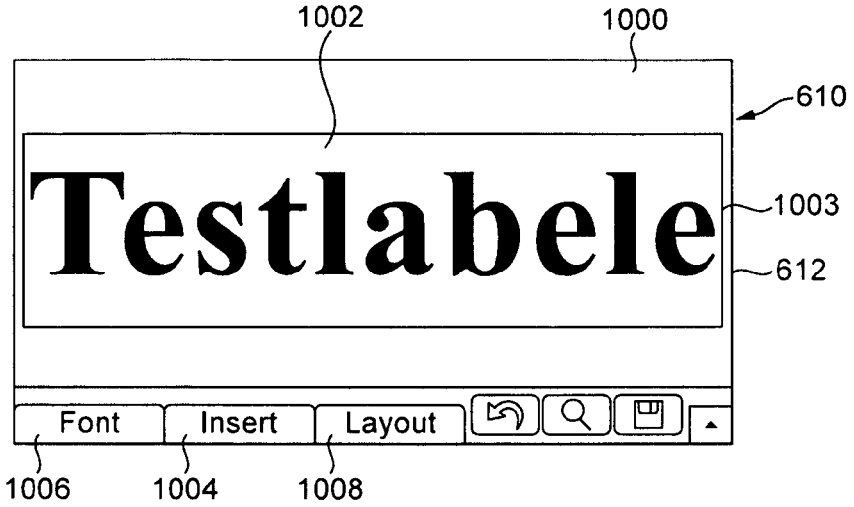

Reference is now made to FIG. 5*e*. In comparison with FIG. 5*d*, an additional character has been inserted. The width of the displayed label is now decreased to 56% of the available width W of the display area 1000. All of the characters input are displayed.

Figure 5F:
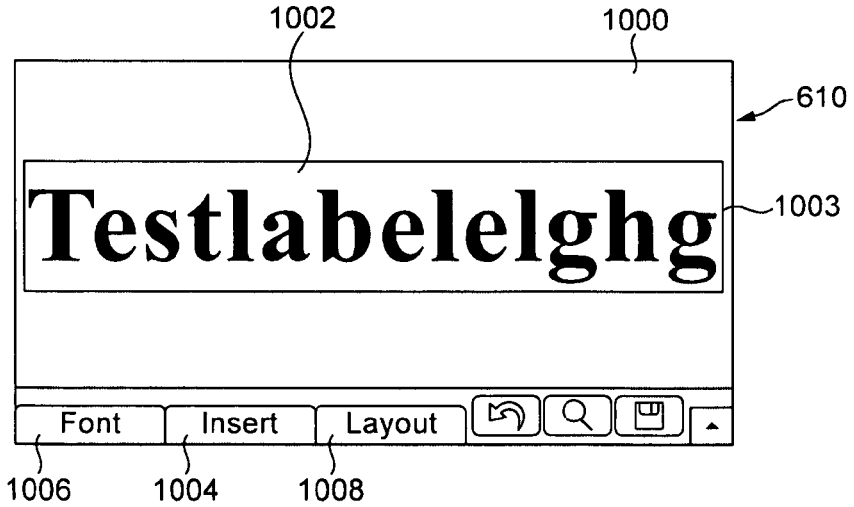

Reference is now made to FIG. 5*f*. Once again, the user has continued to add characters. However, to be able to display all of the input characters along the length of the label, the displayed image is such that the width of the displayed image is 40% of the width W of the display area 1000 in FIG. 5*a*.

Figure 5G:
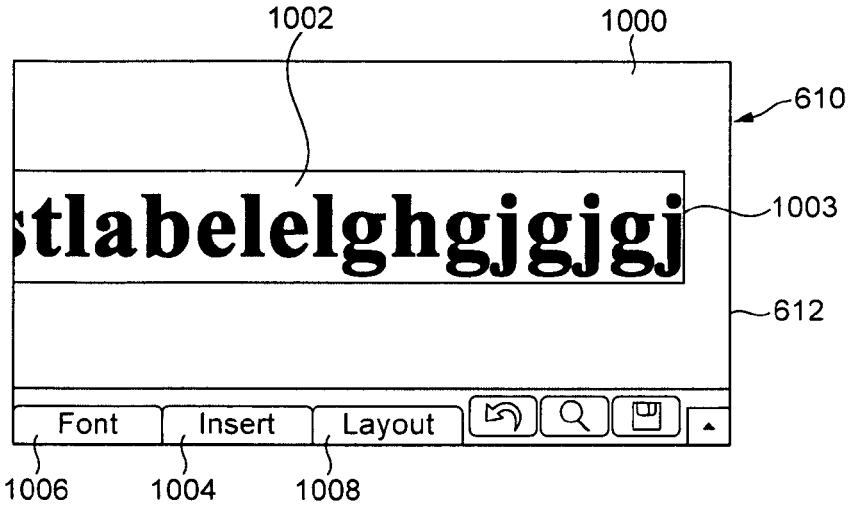

As shown in FIG. 5*g*, the user has continued to enter characters. However, once the width of the displayed image in the display area 1000 has reached a minimum value which is defined as the minimum displayed width to ensure that the input data can be easily read, no further reduction in the used width of the display area 1000 occurs and accordingly, not all of the characters of the label are displayed at the same time.

In this embodiment of the present invention, there is a lower threshold, for example x % of the maximum and the image is scaled as each character is added. The scaling may be such that the largest possible image width is used which allows all the characters to be displayed until the lower threshold has been reached. After that, the lower threshold is used to define the width of the displayed image and not all the characters are displayed.

In this example, the width of the displayed label is 34% of the available width W of the display area, which corresponds with a height of about 15 mm. Alternatively, the minimum width of the displayed label is about 10 mm to ensure that input data remains easily readable. These values for the minimum width are by way of example only and of course different values (absolute or percentage values) may be used in alternative embodiments of the invention. X can have any other suitable value. For example x may alternatively be 25% in some embodiments.

It should be appreciated that reference has been made to the input of characters. Of course, it should be appreciated that the input may additionally or alternatively include numerals symbols, objects or any other item which is printable on the label.

In order to look at the label in this situation, the user can move the cursor, along the length of the label. As the cursor moves across the label, the part of the label which is displayed will change so that the user is able to select which part of the label is displayed in the display area 1000. Alternatively, the user can select which part of the label is displayed by sliding or swiping on the touch screen.

Alternatively or additionally, there may be a preview function which, when selected, causes the image of the label to be for example scrolled across the display area 1000.

It should be appreciated that, in some embodiments of the invention, the length of the image which is displayed is scaled so that it is in proportion to the width dimension of the label which is displayed.

Figure 12:
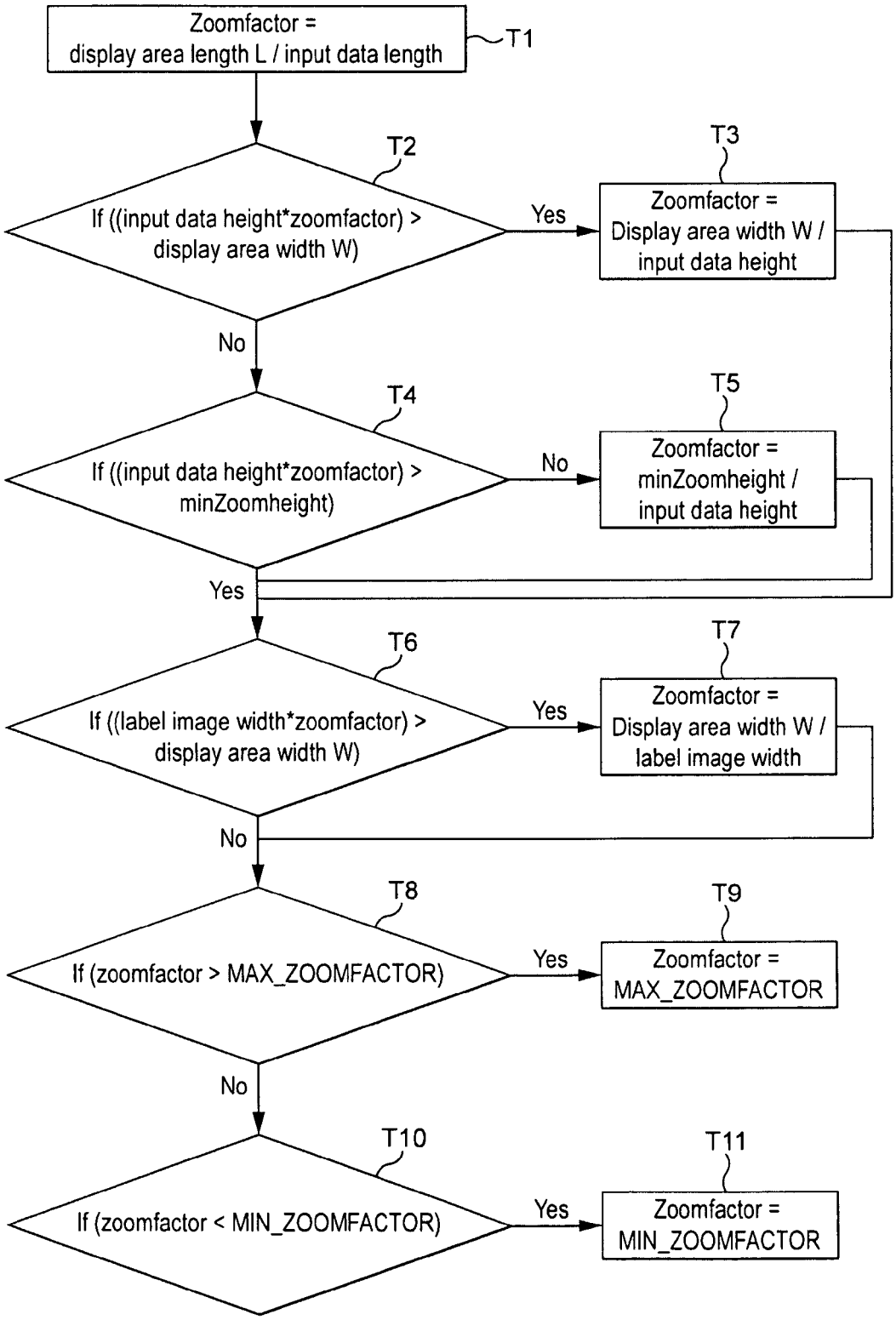
FIG. 12 shows a flow diagram of a method embodying the invention.

Reference is made to FIG. 12 which shows a method which may be implemented to provide the displays shown in FIG. 5.

In step T1, a zoom factor is determined which is the display area length divided by the input data length.

In step T2, it is determined if the input data height multiplied by the zoom factor is greater than the display area width W. It should be appreciated that the input data height is the height of the input data including any borders. The input data height may include data from one or more lines of a label. The data can be any input data including characters, symbols, numbers, boxes, objects, underlining or the like.

If the input data height multiplied by the zoom factor is greater than the display area width W, the next step is step T3 and the zoom factor is altered to the display area width divided by the input data height. The step after step T3 is step T6 which will be described later.

If the input data height multiplied by the zoom factor is not greater than the display area width W, the next step is step T3 and it is determined if the input data height multiplied by the zoom factor is greater than the minimum zoom height.

If the input data height multiplied by the zoom factor is not greater than the minimum zoom height, then the next step is step T5. In step T5, the zoom factor is the minimum zoom height divided by the input data height. Step T5 is followed by step T6.

If the input data height multiplied by the zoom factor is greater than the minimum zoom height, then the next step is step T6.

In step T6, it is determined if the input data width multiplied by the zoom factor is greater than the display area width W. The zoom factor is the zoom factor output in step T3, step T4 or step T5. The input data width is the height of the input data height as well as the upper and/or lower margins of the label.

If it is determined that the input data width multiplied by the zoom factor is greater than the display area width W then the next step is step T7 in which the zoom factor is the display area width W divided by the label image width. The step after T7 is step T8.

If it is determined that the input data width multiplied by the zoom factor is not greater than the display area width W, then the next step is step T8 where it is determined if the zoom factor is greater than the maximum zoom factor. The zoom factor used in step T8 is the zoom factor from step T7 or step T6.

If the zoom factor is greater than the maximum zoom factor then the next step is step T9 where the zoom factor is selected to the maximum zoom factor. This is the used zoom factor.

If the zoom factor is not greater than the maximum zoom factor, it is determined in step T10 if the zoom factor is less than the minimum zoom factor. If so, the next step is step T11 where the zoom factors is set to a minimum zoom factor. This is the used zoom factor.

If the zoom factor is not less than the minimum zoom factor the zoom factor received from step T8 is used.

The method shown in FIG. 12 may be performed each time the image is altered either by adding an image element or removing an image element. The zoom factor calculated is thus a scaled value which can take values between a minimum and maximum value. In some embodiments, there may be no maximum and/or minimum zoom values.

In some embodiments one of the input data height and the label image width only may be used, simplifying the method shown in FIG. 12.

In an alternative embodiment the zoom value may be controlled in steps. In this regard, reference is made to FIG. 10 which shows a method embodying the invention.

In this embodiment, the width values of the displayed image in the display area 1000 are 100%, 75%, 50% and 25% of the maximum width W of the display area 1000. It should be appreciated that these values are by way of example only and different values may be selected. More or less than four values may be used in other embodiments.

In step S1, it is determined if a new label has been entered. If so, the next step is step S2. In this step, it is determined whether a character has been input.

If a character has been input, the next step is step S3 where a determination is made as to whether all the characters which have been input can be displayed. This is with a displayed label having a width which is the same as the width of the display area. If all the input characters can be displayed, the next step is step S2 again.

If all the characters which have been input cannot be displayed in a displayed label having a width which is the same as the width of the display area, the next step is step S4 where the displayed image width is reduced to 75% of the width of the display area.

In step S5, a determination is made as to whether all the input characters can be displayed in a displayed label having a width which is 75% of the width of the display area.

If the answer is yes, the next step is step S6 where a determination is made as to whether or not a character has been input. If so, the next step is again step S5.

If it is determined in step S5 that not all the characters can be displayed in a displayed label having a width which is the 75% of the width of the display area, then, in step S7, the displayed image has a width which is 50% of the width of the display area.

In step S8, a determination is made as to whether all the input characters can be displayed in a displayed label having a width which is 50% of the width of the display area.

If the answer is yes, the next step is step S9. It is determined in step S9 if a character has been input. If so, the next step is step S8 again.

If it is determined in step S8 that not all the characters can be displayed in a displayed label having a width which is the 50% of the width of the display area, then, in step S10, the displayed image has a width which is 25% of the width of the display area.

In one embodiment, after step S10, there is no further reduction in the width of the displayed image with respect to the width of the display area.

Figure 10:
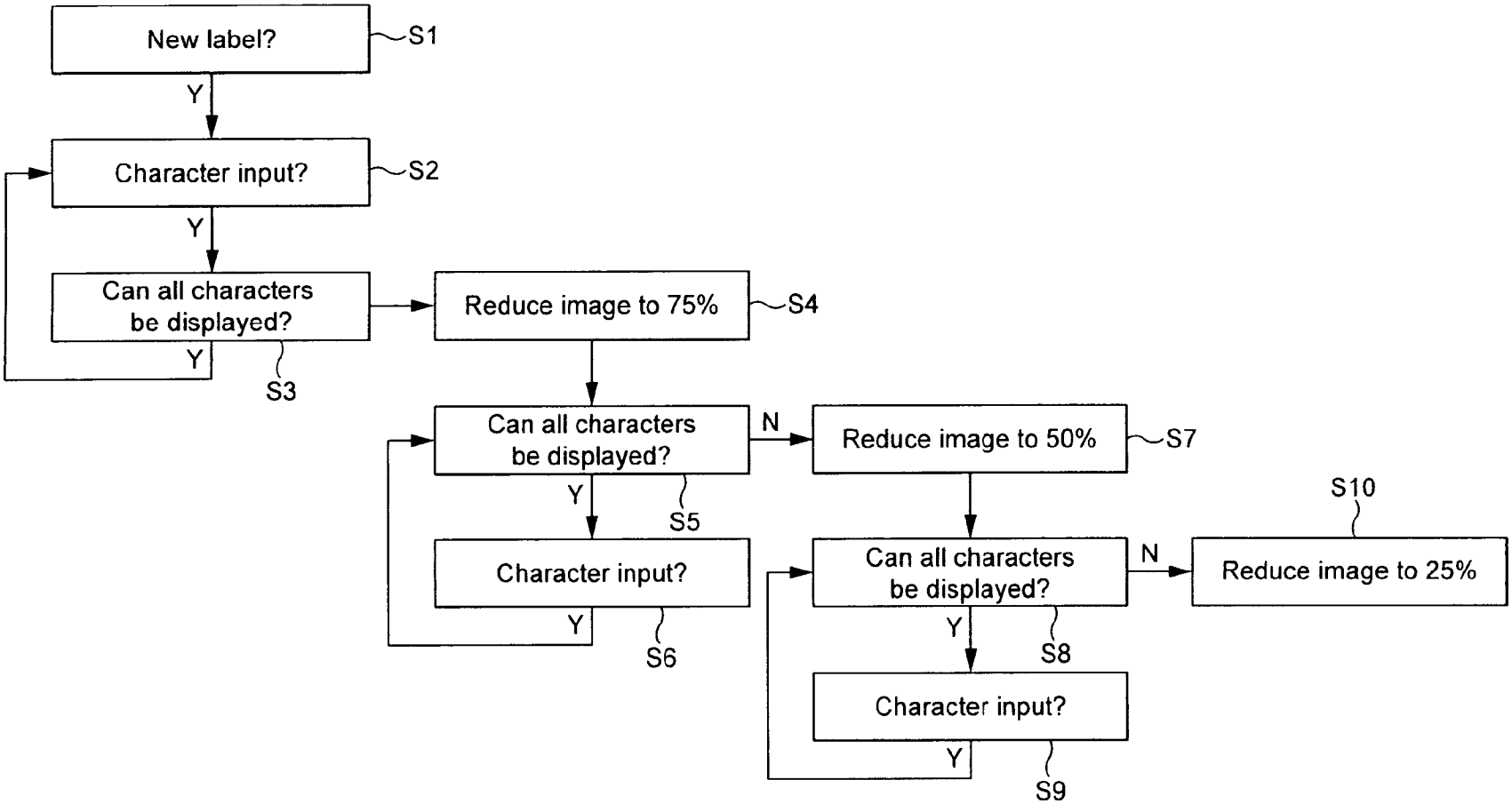
FIG. 10 shows a flow diagram of a method embodying the invention.
Figure 11:
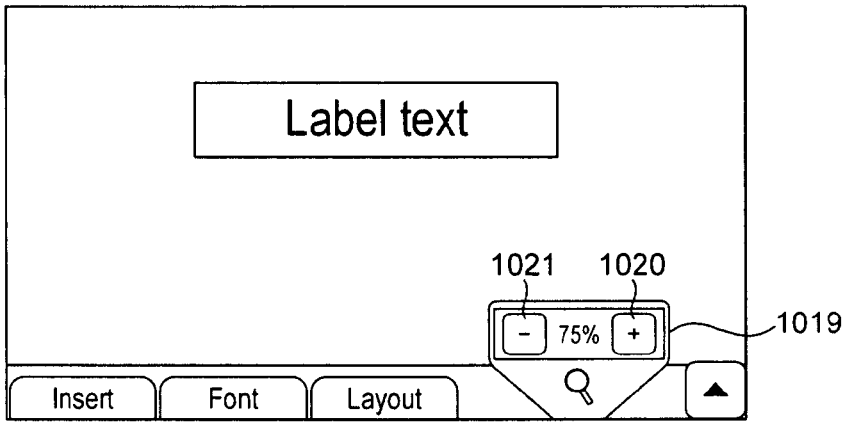
FIG. 11 shows a further display of a label printer in an embodiment of the invention.

The method shown in FIG. 10 or 11 may be performed by one or more processing units in conjunction with for example one or more memories. The method of FIG. 10 may be implemented by a computer program running on one or more processing units. The one or more processing units may be the controller 600 and/or the display controller. The computer program itself may be provided in one or more memories.

It should be appreciated that the embodiments described in relation to FIGS. 5, 10 and 11 have been described in the context of a new label. Alternatively or additionally, this arrangement may be used where a previously stored label has for example been opened.

In one embodiment, a determination may be made as to whether all of the label can be displayed with a 100% width of the width of the display area. If not, it is determined if the label can be displayed with a 75% width of the width of the display are. If not, a determination is made as to whether the label can be fully displayed with a 50% width and if not, the label is displayed with a 25% width and if necessary not all of the characters or the like are displayed in the display area.

In another embodiment a single calculation is performed to determine which width should be used to display the label in the display area, rather than the iterative processes described above.

In an alternative embodiment, the user has the option to select how the image of the label is displayed in the display area 1000. A first selectable option is showing as much as possible of the input data in the length direction keeping into account a minimum displayed height of the image of the label. This is the method as discussed above. A second selectable option is showing the input data such that the image of the label uses always 100% of the width of the display area. Alternatively, more options are provided to the user, and the user can for example select between 100%-75%-50%-25% of the available display area, or the user can select between absolute dimensions 10 mm-15 mm-20 mm, or between a point size for the characters.

Of course, the alternatives described in relation to the embodiments of FIGS. 5 and 10 may also be used where a stored label is opened.

A previously saved label may be opened and edited. The previously described embodiments of the present invention may also be applied in this embodiment.

It should be appreciated that in some embodiments of the invention, the width of the display area for the display of the label may change depending on what other information or options is being displayed by the display. In such embodiments the minimum percentage value of the width of the displayed label with respect to the available width of the label display area may change if the actual width of the label display area changes. In other embodiments, the minimum percentage value is unchanged, regardless of any change in the actual width of the label display area.

As shown in FIG. 5, adjacent to the layout tab 1008 is a undo area 1005. When activated by the user using for example using a mouse or by the user touching that area, the previous editing operation is undone. This button can be activated up to N times in order to undo the previous N edit operations. N may be any suitable value and in one embodiment of the present invention may for example be 5.

Next to the undo area 1005, is a zoom area 1001 which allows a user to zoom in and/or out of an image. In one embodiment, the zoom control would operate in steps of 25%. The lowest zoom value would be 25% and the highest zoom value may depend on the tape width. For example the small tape sizes may have a zoom up to for example 200%. The largest tape sizes may have for example zoom up to for example 100%. Tape sizes in between the largest and the smallest may have zoom steps up to a zoom value between the zoom values for the largest and smallest label widths, for example 150%.

In one embodiment, different lower limits may be provided for different widths of tape/labels.

Other step sizes may be used in embodiments of the invention. In some embodiments of the invention, the step size may depend on the width of the label medium. Other zoom values may be used in some embodiments of the invention. The smallest and/or largest zoom sizes may be dependent on the width of the label medium.

The zoom values may be defined with respect to the display area 1000 and/or may be defined with respect to the width which has been set for the label and/or of the medium present in the label printer.

When the zoom area 1001 is enabled, the display shown in FIG. 11 is shown. A zoom area 1019 is shown. In this zoom area 1019, there is one area 1021 for decreasing the zoom and one area 1020 for increasing the zoom. For each touch and release on the plus or minus zoom area increase/decreases the zoom factor by one step. The area containing the plus and minus zoom areas 1021 and 1020 may be provided in the part of the display A which is used to accommodate the image of the label. In alternative embodiments of the invention, the zoom area 1019 can be provided at a different position on the display.

In some embodiments, when at the highest or lowest zoom factor possible, the respective increase or decrease button may be disabled.

The zoom area 1001 represents a manual zoom function which may be provided along with the automatic zoom function previously described. The zoom area 1001 when activated will thus open the overlay area 1019 containing the zoom in and zoom out areas 1021 and 1020. Furthermore, a percentage indicator is provided which indicates the percentage of zooming In one modification, the user may press on the respective zoom in or out button and the amount of zooming in or out will be dependent on how long the user activates the particular area.

Figure 6:
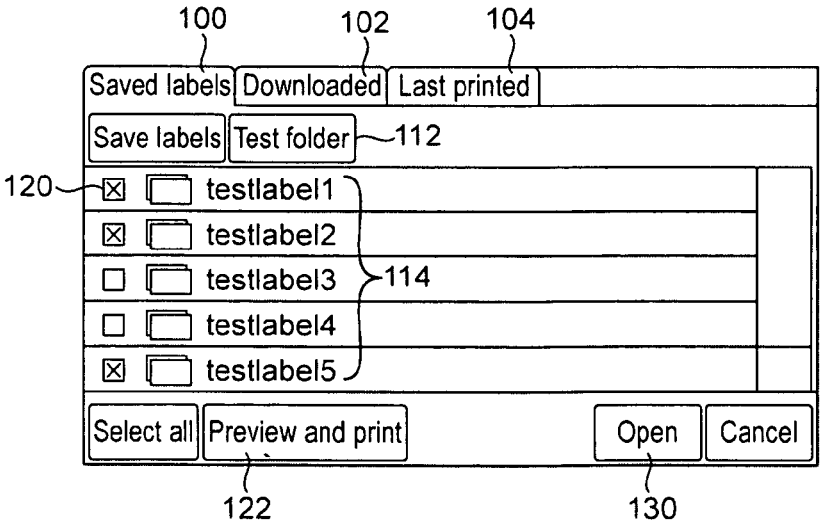
FIG. 6 shows a further display of a label printer in an embodiment of the invention.
Figure 7:
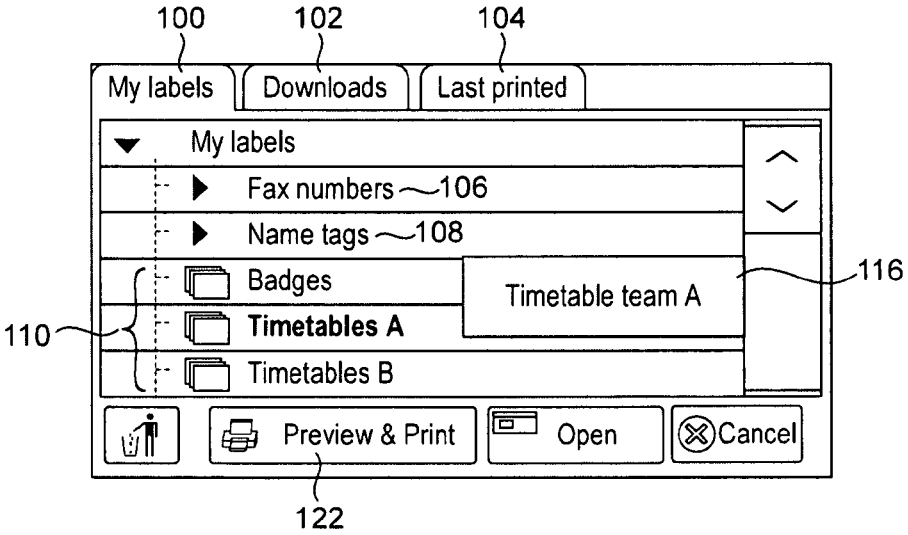
FIG. 7 shows a further display of a label printer in an embodiment of the present invention.

Reference is now made to FIGS. 6 and 7. In an embodiment of the present invention, a tree structure may be provided for saved labels. For example, the labels may be provided in three categories: saved labels 100 (referred to as my labels in FIG. 7), downloaded labels 102; and last printed labels 104. It should be appreciated that the number of categories of labels can be one or more. The categories may of course be different in other embodiments to the three categories shown in FIGS.

6 and 7. As can be seen in FIGS. 6 and 7, the labels in the saved labels (or my labels) 100 category are shown.

The labels may be individually saved or may be within sub-folders within the saved label folder. As can be seen for example from FIG. 7, two sub-folders 106 and 108 are shown. Sub-folder 106 for example contains fax numbers whilst sub-folder 108 contains name tags. In the example shown in FIG. 6, there is a sub-folder called test folder 112.

The labels shown in FIG. 7 show in addition to the two sub-folders 106 and 108 some individual labels 110. The names of the individual labels are displayed in the list. The subfolders are also displayed in this list. In the arrangement of FIG. 6, the sub-folder 112 (test folder) has been selected and the individual labels 140 in that sub-folder 112 are shown. It is of course possible to have sub-folders within a sub-folder. In alternative embodiments of the invention, the folder of saved labels may not have any sub-folders.

In an embodiment of the present invention, when a particular label is selected from the list of labels (either by the user touching the area associated with that label or with a cursor), a preview of that label will be shown. Accordingly, as the user moves for example his finger or a cursor down a list of labels, a preview of the respective labels will be successively displayed. In FIG. 7, an example of a preview 116 of one of the labels is shown. The preview label 116 is arranged in an area of the display to one side of the label names in the displayed list. In other words, the preview label is in the area associated with the list of label names but is positioned to one side so at least part of the names of the labels in the list are still displayed.

The preview label may be printed directly by the activation of a print area or a print hardware key Alternatively or additionally, where there is a list of labels and one of the labels has been highlighted for example with a cursor, that highlighted label may be printed directly by activation of a print area or a print hardware key. By printed directly is meant that printing occurs without the provision of a print option menu and without any further input required by the user.

In one embodiment of the present invention, check boxes 120 are provided in the list of labels, one box next to each label name. These boxes allow a user to select one or more labels. The label can be selected by using for example a mouse click or the user pressing once or twice on the box. The user is then able to print out the labels which have been selected without individually selecting each label to be printed out The printing may be done by selecting the 'preview and print' area 122 of the screen. In the embodiment shown in FIGS. 6 and 7, the preview and print area 122 is arranged below the list of labels. However, this is by way of example only and the preview and print area 122 may be positioned elsewhere in the display or may be a hardware button arranged adjacent the display. When the preview and print area 122 is activated, the labels which will be printed are first displayed and then printed In one modification, the labels which are selected may simply be printed, without any preview of the label occurring. In another modification, the print area when activated will cause one or more print options to be displayed which can be selected by a user.

It should be appreciated that the selection mechanism described in relation to FIG. 6, may for example also be used for selecting label to be transferred to a memory device and/or to a connected PC.

Alternatively or additionally, all of the selected labels may be opened by activating an open area 130 on the display.

Therefore, some embodiments of the present invention, which may include displays with a relatively small area (such as equal to or less than 50 $cm^2$), make optimum use of the available space on the display 610 by limiting the amount of information displayed. By ensuring that only one graphical control panel of a plurality of graphical control panels is displayed on the display at once, both the image representative of the label and the graphical control panel can be displayed larger than if more than one graphical control panel was displayed. Therefore, the user is able to more clearly read and comprehend what is shown on the display, thus facilitating their creation of a label.

Herein several references are made to a user "selecting" a desired area, part or region of a display or a button or similar shown on a display. When the display is comprised in a touchscreen (see FIG. 3), this selecting comprises the user touching the touch panel of the touchscreen at a location overlying the area, part, region or button or similar shown on the display of the touchscreen that it is desired to select. When the display is not comprised in a touchscreen, the selecting may comprise the user operating an input device (such as a mouse or a hardware key) to position a cursor over the area, part, region or button or similar that it is desired to select, and then operating a selector of the input device (such as a button on a mouse).

It is advantageous for the label printer of the present invention to be portable and/or capable of being held in the hand of an operative, i.e. to be handheld. The label printer may be powered by one or more batteries or by a mains source of energy.

In the illustrated embodiments, the various images representative of the appearance of labels or label media each comprise an outline of the label or label media. In alternative embodiments, one or more of the images representative of the appearance of labels or label media comprises an image of a label or media with an appearance different from that of an appearance of a background within which the image is located. So, the image may be white and the background may be shaded, or vice versa, or the image may be plain coloured and the background patterned, or vice versa, for example.

The term "image representative of the appearance of . . . " used in this application is preferably intended to mean that the image has the same proportions and possibly the same colouring or rendering as the real life label medium or label that it represents. The images are preferably sufficiently representative for a user of the label printer to be able to visualise what the label medium or label would look like in reality.

Apparatuses that may be used to input data to the label printer for printing include an integral keyboard, an integral touch panel of a touchscreen, a mouse, or a digital camera or a mobile phone connected to the label printer. Images may alternatively be stored in, and input by using, a smart card, chip card, memory card or the like.

While references are made above to the label printer storing data in (or retrieving data from) memory, this memory may form an integral part of the label printer. Alternatively, the memory may not be integral with the label printer. In that case, the label printer is arranged to communicate with the memory via one or more ports or interfaces of the label printer.

In contrast to embodiments of the present invention (which concern stand-alone label printers, as discussed above), a label printer system comprises a printer connected to a PC or other computer. The printer of such a label printer system may not have a display, and/or may not have input means for selecting characters to be printed, and/or may not have input means for selecting something shown on a display. However, in some cases the printer of such a label printer system will additionally have the display and/or suitable input means.

Figure 8:
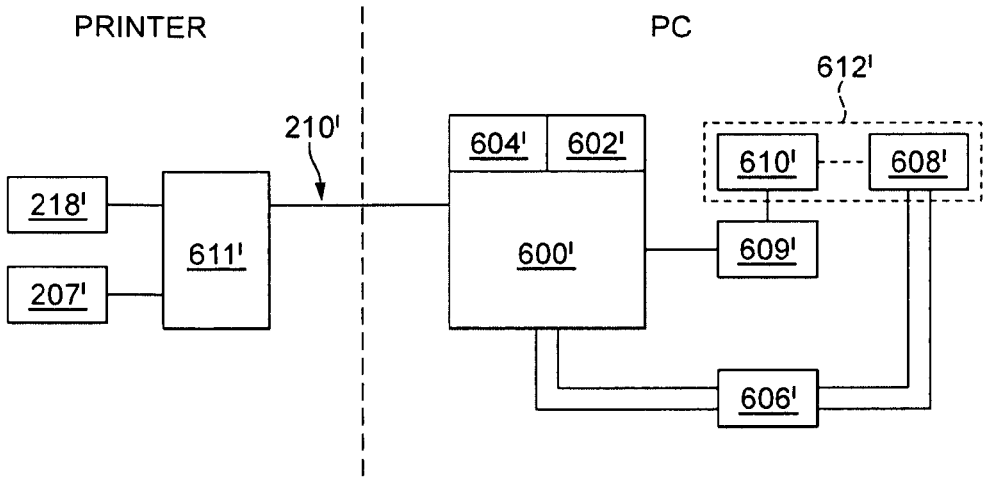
FIG. 8 is a diagrammatic sketch showing the control circuitry in a label printing system.
Figure 9:
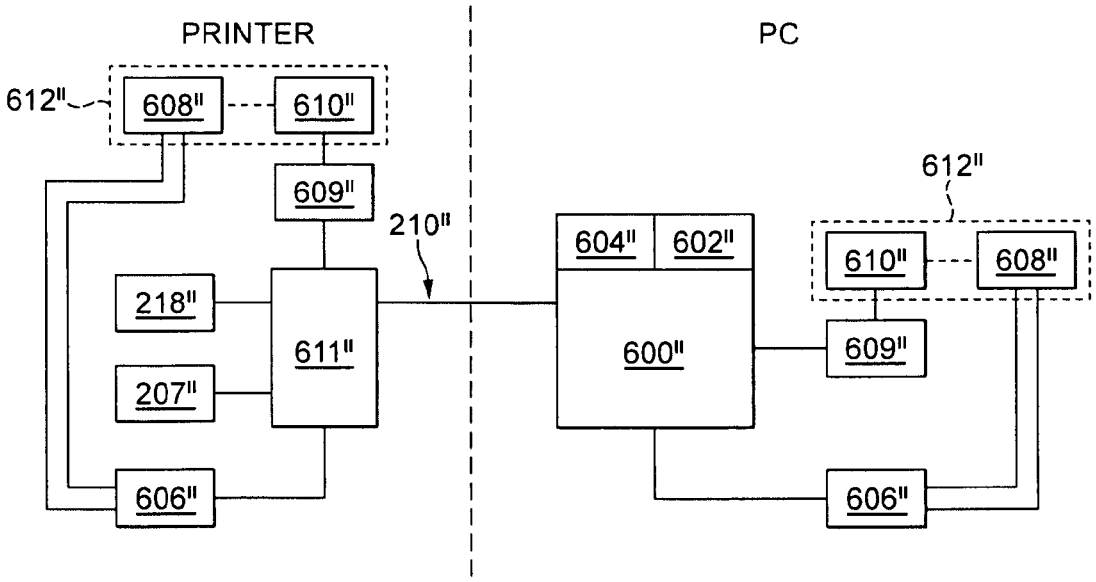
FIG. 9 is a diagrammatic sketch showing the control circuitry in a further label printing system.

FIG. 8 illustrates a label printer system in which a printhead 218' and tape feeding motor 207' are included in a printer connected via a link 210' to a PC, and a display 610' of a touchscreen 612', touchscreen display driver 609', touch panel 608' of the touchscreen 612', touch controller 606', controller 600', non-volatile memory 602', and volatile memory 604' are part of the PC. The printer may include a further controller or control means (illustrated as 611') for facilitating communication between the controller 600' of the PC and the printhead 218' and motor 207' of the printer. The link 210' may be a wired link, e.g. involving a parallel or serial connection or a USB interface, or a wireless link, e.g. involving Bluetooth technology or an infrared link. The printer and the PC together form a label printer system. FIG. 9 illustrates a variation of the system shown in FIG. 8, in which variation the printer and the PC (together forming a label printer system) both include a display 610" of a touch screen 612", touch screen display driver 609", touch panel 608" of the touch screen 612", and touch controller 606".

While the term "controller" has been used extensively throughout this description, it is to be appreciated that different types of apparatus may be used as a controller. Such apparatus includes a processor, a chip, a set of chips (i.e. a chip set), or other form of control means. Such a controller or control means may be configurable to output data to a display driver (for driving a display) on the same chip as the controller or on a chip separate from the controller. Thus the term "output" in this respect is intended to mean transferring the data from the controller to the display driver. Even when the display driver is comprised in the same chip as the controller, some degree of communication or "output" is carried out between the controlling part and the display driving part of the chip. This data is for causing the display driver to drive the display to display a certain image or images. The controller or control means may generate this data, or it may be generated elsewhere (e.g. on another chip or in a different part of a chip) and then provided to the controller for outputting to the display driver.

The display discussed in this description and illustrated in the accompanying figures is one example of display means. The display means may comprise one of an LCD display, a plasma display, a cathode ray tube, an OLED display or other form of display.

The skilled person would appreciate that any of the methods described herein may be implemented using a computer program embodied on a computer readable medium (such as a CDROM or memory within a stand-alone printer) for controlling a controller (or other similar apparatus as discussed above).

Embodiments of the invention may be used with continuous tape or die cut labels. Die cut labels are provided on a continuous backing layer but are discrete, pre-cut labels. The tape or die cut labels may be provided in a cassette or simply on a roll.

The foregoing merely illustrates the principals of the invention. Modifications and alterations to the described embodiments will be apparent to those skilled in the art in view of the teaching herein. It will thus be appreciated that those skilled in the art would be able to devise numerous techniques which although not explicitly described herein, embody the principals of the invention and are thus within the scope of the invention, as defined by the claims.

The invention claimed is:

1. A label printer comprising:

input means operable by a user to input label data;

display means; and control means configured to receive said input label data from the input means and to control the display to display an image representative of a label medium in a label display area, the image representative of a label medium comprising an outline representative of the edges of a label medium;

wherein in response to receiving input label data said control means is configured to cause said display to adjust the size of said image representative of the label medium such that a first dimension of said image representative of the label medium is decreased with respect to a corresponding dimension of said display area so that all of said image representative of the label medium is displayed in said display area;

wherein said control means is configured to adjust the size of said image representative of the label medium as said input label data are received;

wherein said control means is configured to cause said display to display said image representative of said label medium such that all of said image representative of said label medium is displayed only if said first dimension of said label image is above a predetermined threshold value with respect to the corresponding dimension of the display area, such that said input label data remain readable as said input label data are received; and wherein when said first dimension reaches said predetermined threshold value, no further reduction of said first dimension occurs as said input label data are received so that said image representative of said label medium is enabled to extend beyond said display area, and the user is able to select which part of said image representative of said label medium is displayed in said display area.

2. A label printer as claimed in claim 1, wherein said control means is configured to provide n steps for the decreasing of the first dimension where n is an integer of 2 or more.

3. A label printer as claimed in claim 2, wherein said controller is configured to reduce said first dimension by only one step if all of said image representative of said image of said label medium can be displayed in the display area.

4. A label printer as claimed in claim 2, wherein each step is the same size.

5. A label printer as claimed in claim 1, wherein said control means is configured to determine for each new input of label data if all said image representative of the label medium, defined by said input label data including said new input data, can be displayed on said display and if not to reduce said first dimension by at least one step.

6. A label printer as claimed in claim 1, wherein said predetermined value comprises between 20% to 35% of the corresponding dimension of the display area.

7. A label printer as claimed in claim 1, wherein said predetermined value comprises at least 10 mm of the corresponding dimension of the display area.

8. A label printer as claimed in claim 1, wherein said control means is configured to control the display to display said image representative of the label medium with a maximum size of said first dimension being equal to the maximum size of the corresponding dimension of the display.

9. A label printer as claimed in claim 1, wherein said control means is configured to control the display to display said image representative of the label medium with a zoom factor such that only part of the label in the first dimension is displayed, said zoom value having a maximum value.

10. A label printer as claimed in claim 1, wherein said first dimension comprises a width dimension.

11. A label printer as claimed in claim 1, wherein said display comprises a touch screen.

12. A label printer as set forth in claim 1, wherein said input label data comprise at least one selected from the group consisting of text data; numerical data; barcode data; image data; symbol data; shape data; and object data.

13. A method for controlling a display of a label printer, said method comprising:

receiving input label data;

in response to said receiving input label data, adjusting the size of an image of representative of a label medium, the image representative of a label medium comprising an outline representative of the edges of a label medium, wherein said adjusting comprises reducing a first dimension of said image representative of the label medium with respect to a corresponding dimension of a display area of said display so that all of said image representative of the label medium can be accommodated in said display area;

causing said display to display said image representative of the label medium in said label display area;

causing said display to adjust the size of said image representative of the label medium as said input label data are received;

wherein the method comprises causing said display to display said image representative of said label medium such that all of said image representative of said label medium is displayed only if said first dimension of said label image is above a predetermined threshold value with respect to the corresponding dimension of the display area, such that said input label data remain readable as said input data are received; and, wherein when said first dimension reaches said predetermined threshold value, no further reduction of said first dimension occurs as said input label data are received so that said image representative of said label medium is enabled to extend beyond said display area, and the user is able to select which part of said image representative of said label medium is displayed in said display area.

14. A computer program stored on a non-transitory computer-readable medium, said computer program comprising program code means configured to perform the steps of claim 13.

* * * * *